US005164356A

United States Patent [19]

Dalebroux

[11] Patent Number: 5,164,356

[45] Date of Patent: Nov. 17, 1992

[54] THERMALLY-RESPONSIVE RECORD MATERIAL

[75] Inventor: Dean G. Dalebroux, Green Bay, Wis.

[73] Assignee: Appleton Papers Inc., Appleton, Wis.

[21] Appl. No.: 791,754

[22] Filed: Nov. 12, 1991

[51] Int. Cl.[5] ..... B41M 5/30

[52] U.S. Cl. ..... 503/208; 503/209; 503/216; 503/225

[58] Field of Search ..... 503/208, 209, 216, 225

[56] References Cited

U.S. PATENT DOCUMENTS 4,880,766 11/1989 Miller et al. ..... 503/225

*Primary Examiner*—Pamela R. Schwartz

*Attorney, Agent, or Firm*—Benjamin Mieliulis

[57] ABSTRACT

Thermally-responsive record materials are described containing a "complex" material formed from interactions at high pH between zinc stearate and ammonia and/or zinc stearate, ammonia and zinc oxide. The use of these materials in thermally-responsive sheets improves thermal image response and/or improves resistance to thermal image decline upon exposure to elevated temperature.

10 Claims, No Drawings

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material (electron-donating dye precursors) and acidic color developer material. This invention particularly concerns a thermally-responsive record material capable of forming a non-reversible image resistant to fade or erasure due to contact with oils, solvents or exposure to elevated temperature. The invention teaches a record material having improved image density retention.

2. Description of Related Art

Thermally-responsive record material systems are well known in the art and are described in many patents, for example, U.S. Pat. Nos. 539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a colored image of sufficient intensity upon selective thermal exposure. Improvements in thermal response would be of commercial significance.

A drawback of thermally-responsive record materials limiting utilization in certain environments and applications has been the undesirable tendency of thermally-responsive record materials upon forming an image to not retain that image in its original integrity over time when the thermally-responsive record material is exposed to elevated temperatures in use or storage. As a result, due care and control in handling imaged thermally-responsive record materials has been required. This loss of image density or fade can be annoying and detrimental whenever the integrity of records is allowed to become suspect through improper record storage.

The ability of a thermally-responsive record material to resist image decline upon exposure to elevated temperatures would be an advance in the art and of commercial significance.

It is an object of the present invention to disclose a thermally-responsive record material having improved image retention at elevated temperatures, and/or improved thermal response.

DETAILED DESCRIPTION

The present invention is a novel thermally-responsive record material bearing a thermally-sensitive color-forming composition comprising a chromogenic material, an acidic developer material, a sensitizer, and a zinc stearate and ammonia complex.

The chromogenic material and acidic developer material and the zinc stearate and ammonia complex are in substantially contiguous relationship whereby the melting, softening or sublimation of the chromogen or developer produces a change in color by reaction between the latter two.

The chromogenic material is an electron donating dye precursor. The developer material is an electron accepting material.

The zinc stearate/ammonia complex is made by adding concentrated ammonium hydroxide (approximately 28% ammonia) to a zinc stearate dispersion or emulsion until a pH above 10, preferably a pH of approximately 10.8 to 11.5 is achieved.

The effect of the zinc stearate/ammonia complex can be favorably enhanced by the optional presence of zinc oxide solubilized in ammonium hydroxide. It was found that approximately 0.56 weight percent of zinc oxide will solubilize in a 28% solution of ammonium hydroxide.

The record material is characterized by containing a "complex" formed from the addition of ammonia to zinc stearate. A thermally-responsive sheet containing this complex has improved thermal image response and/or improved resistance to thermal image decline upon exposure to elevated temperature.

In addition to the zinc stearate/ammonia complex the thermal sheet contains a colorless chromogenic material, an acidic material, and optionally but preferably a sensitizing material. Other materials such as fillers, antioxidants, lubricants, waxes and brighteners may be added if desired.

The thermal performance of the sheet is measured by imaging the sheet on a dynamic test device, in this case an *Atlantek Thermal Response Tester*, Model 200. The thermal testing unit images the sheet with a thermal printhead, using a constant power voltage, a constant cycle time, and a sequentially increasing dot pulse duration resulting in a series of thermal images of increasing intensity. The thermal images are measured using a MacBeth RD-922 Densitometer. The densitometer is calibrated such that 0.04 indicates pure white and 1.79 a fully saturated black image.

Resistance to image intensity decline upon exposure to elevated temperature is measured by placing a dynamically imaged sheet in a 60° C. oven for a period of 24 hours. The image intensity is measured both before and after this exposure period.

In addition to the chromogen, developer, and complex other materials such as sensitizers, fillers, antioxidants, lubricants, waxes, binders and brighteners optionally may be added if desired.

The thermally-responsive record material of the invention has the unexpected and remarkable properties of being capable of forming a substantially non-reversible high density image upon selective thermal contact and of resisting image decline over time when the imaged record material is exposed to high heat.

The color-forming system of the record material of this invention comprises electron donating dye precursors, also known as chromogenic material in its substantially colorless or light-colored state, acidic developer material, and the zinc stearate/ammonia complex. The color-forming system relies upon melting, softening, or subliming of the chromogen and/or developer to achieve reactive, color-producing contact.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical.

The components of the color-forming system are in substantially contiguous relationship, substantially homogeneously distributed throughout the coated layer material deposited on the substrate. The term substantially contiguous is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components positioned in a subsequent layer or layers. All such arrangements are understood herein as being substantially contiguous.

In manufacturing the record material, a coating composition is prepared which includes a fine dispersion of the components of the color-forming system, binder material preferably polymeric binder such as polyvinyl alcohol, surface active agents and other additives in an aqueous coating medium. The composition can additionally contain inert pigments, such as clay, talc, silicon dioxide, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, sensitizers and antioxidants. Sensitizers, for example, can include acetoacet-o-toluidine, phenyl-1-hydroxy-2-naphthoate, 1,2-diphenoxyethane, and p-benzylbiphenyl. Use of sensitizer, specifically material such as 1,2-diphenoxyethane is preferred in all record system combinations herein. The sensitizer typically does not impact any image on its own but as a relatively low melt point solid, acts as a solvent to facilitate reaction between the mark-forming components of the color-forming system.

The color-forming system components are substantially insoluble in the dispersion vehicle (preferably water) and are ground to an individual average particle size of less than about 10 microns, preferably less than 3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible electron donating dye precursors are chromogenic compounds, such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spiro-dipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No, 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl) -5,7-dihydrofuro[3,4-b]pyridin-5-one; 3-diethylamino-7,8 -benzofluoran; 3,3 -bis(1-ethyl-2-methylindol-3-yl) phthalide; 3-diethylamino-7-anilinofluoran; 3-diethylamino-7-benzylaminofluoran; 3'-phenyl-7-dibenzylamino-2,2'-spiro-di-[2H-1-benzopyran] and mixtures of any of the following.

Examples of eligible acidic developer material which can be used in the invention include the compounds listed in U.S. Pat. No. 3,539,375 as phenolic reactive material, particularly the monophenols and diphenols. Other eligible acidic developer material which can be used also include, without being considered as limiting, the following compounds:

4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxy-phenyl ketone; 2,2-bis(4-hydroxyphenyl)-5 -methylhexane; ethyl-4,4-bis(4-hydroxyphenyl)-pentanoate; isopropyl-4,4 -bis(4-hydroxyphenyl)pentanoate; methyl-4,4-bis(4-hydroxyphenyl)pentanoate; allyl-4,4-bis(4-hydroxyphenyl)pentanoate; 3,3-bis(4-hydroxyphenyl)-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octylphenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol, ethyl-4,4-bis(4 -hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, and benzyl-p-hydroxybenzoate. Acid compounds of other kind and types are eligible.

2,2'-Bis(4-hydroxyphenyl)-4-methylpentane was preferred.

Examples of other eligible acidic developer compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The thermally-responsive sheets are prepared by making separate dispersions of the chromogenic, acidic developer material, complex and sensitizer materials in an attritor, small media mill or other suitable device (acidic and sensitizing materials may or may not be dispersed together). The zinc stearate/ammonia complex is made by adding concentrated ammonium hydroxide (approximately 28% ammonia) to a zinc stearate dispersion/emulsion until a pH of 10.8 to 11.5 is achieved. These materials are mixed in preferable ratios and other materials are added if desired. The pH of this mixture is then raised to at least 10.5, preferably 10.6 to 11.0 with ammonium hydroxide or other suitable organic or inorganic basic solution. This mixture is then applied to a support substrate using a wire wound Meyer rod and dried, the sheet may also be calendered.

The effect of the zinc stearate/ammonia complex may be enhanced by the presence of solubilized zinc oxide. Zinc oxide is added to the complex by first dissolving it in ammonium hydroxide (approximately 0.56 weight percent of zinc oxide will dissolve in a 28% solution of ammonia). This zinc oxide/ammonium hydroxide solution is then used to titrate the zinc stearate emulsion/dispersion to the appropriate pH (10.8 to 11.5). This complex is then used to prepare a thermally-responsive sheet.

Alternatively, but not preferably, the complex may be generated in situ, by preparing a thermal color blend containing the above chromogenic, acidic, sensitizing and other materials, plus zinc stearate. This blend is then titrated with ammonium hydroxide to a pH of at least 10.5 but preferably 10.6 to 11.0. This mixture is then coated on a substrate.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of less than 10 microns was achieved. The milling was accomplished in an attritor or other suitable milling device. The desired average particle size was less than 3 microns in each dispersion.

DISPERSIONS

Dispersions

| Dispersion A - Chromogenic Material | Parts |
|---|---|
| Chromogenic Material | 33.8 |
| Binder, 20% Solution of Polyvinyl Alcohol (Vinol 205) in Water. | 28.9 |
| Defoaming and Dispersing Agents | .4 |
| Water | 36.9 |
| TOTAL | 100.0 |

Dispersion A-1

Chromogenic Material is N-102, 3-Diethylamino-6-methyl-7-anilinofluoran.

Dispersion A-2

Chromogenic Material is CF-51, 3-(Ethylamino-2-furanamino)-6-methyl-7-anilinofluoran.

Dispersion A-3

Chromogenic Material is Dibutyl N-102, 3-Dibutylamino-6-methyl-7-anilinofluoran.

| Dispersion B - Acidic Material | Parts |
|---|---|
| Acidic Material | 29.7 |
| Binder, 28% Solution of Polyvinyl Alcohol (Vinol 203) in Water | 18.1 |
| Defoaming and Dispersing Agents | .2 |
| Water | 52.0 |
| TOTAL | 100.0 |

Dispersion B-1

Acidic Material is AP-5, 2,2-Bis(4-hydroxyphenyl)-4-methyl pentane.

Dispersion B-2

Acidic Material is Bisphenol A, 2,2-Bis(4-hydroxyphenyl)propane.

| Dispersion C - Sensitizing Material | Parts |
|---|---|
| Sensitizing Material | 29.7 |
| Binder, 28% Solution of Polyvinyl Alcohol (Vinol 203) in Water | 18.1 |
| Defoaming and Dispersing Agents | .2 |
| Water | 52.0 |
| TOTAL | 100.0 |

Dispersion C-1

Sensitizing Material is DPE, 1,2-Diphenoxyethane.

| Dispersion D - Filler Material | Parts |
|---|---|
| Zeosyl 200 ($SiO_2$) | 11.49 |
| Pergopak M-2 at 70% solids (Urea-formaldehyde Resin) | 7.59 |
| Resisto-Coat 135 at 35% solids (Paraffin Wax Emulsion) | 4.00 |
| Defoaming and Dispersing Agents | .10 |
| Binder, 20% Solution of Polyvinyl Alcohol (Vinol 203) in Water | 4.70 |
| Water | 72.30 |
| TOTAL | 100.00 |

| Dispersion E - Acidic and Sensitizing Material Codispersion | Parts |
|---|---|
| Acidic Material (AP-5) | 24.50 |
| Sensitizing Material (DPE) | 24.50 |
| Defoaming and Dispersing Agents | .20 |
| Binder, 20% Solution of Polyvinyl Alcohol (Vinol 203) in Water | 24.30 |
| Water | 26.50 |
| TOTAL | 100.00 |

Water soluble polymers other than polyvinyl alcohol may be used to prepare the dispersions.

The chromogenic, acidic, sensitizing and filler materials listed are illustrative and not intended to be limiting.

| Example 1 (Control) | Parts |
|---|---|
| Dispersion A-1 (Chromogenic Material = N-102) | 4.80 |
| Dispersion B-1 (Acidic Material = AP-5) | 13.44 |
| Dispersion C-1 (Sensitizing Material = DPE) | 13.44 |
| Zinc Stearate Emulsion at 32.3% solids | 3.72 |
| Filler | 5.10 |
| Binder, 10% Solution of Polyvinyl Alcohol in Water | 23.46 |
| Water | 36.04 |
| TOTAL | 100.00 |

| Example 2 (Zinc Stearate/Ammonia Complex) | Parts |
|---|---|
| Dispersion A-1 (Chromogenic Material = N-102) | 4.80 |
| Dispersion B-1 (Acidic Material = AP-5) | 13.44 |
| Dispersion C-1 (Sensitizing Material = DPE) | 13.44 |
| Zinc Stearate/Ammonia Complex at 22% solids | 12.00 |
| Filler | 3.90 |
| Binder, 10% Solution of Polyvinyl Alcohol in Water | 23.46 |
| Water | 28.96 |
| TOTAL | 100.00 |

The pH of Example 2 coating mixture was then raised to pH=10.8 using concentrated ammonium hydroxide (27% ammonia).

See Table 1 for Thermal Image Response and Stability Data.

| Example 3 (Control) | Parts |
|---|---|
| Dispersion A-3 (Chromogenic Material is Dibutyl N-102) | 4.80 |
| Dispersion B-2 (Acidic Material is Bisphenol A) | 13.44 |
| Dispersion C-1 (Sensitizing Material is DPE) | 13.44 |
| Zinc Stearate Emulsion at 32.3% solids | 3.72 |
| Filler | 5.12 |
| Binder, 10% Solution of Polyvinyl Alcohol in Water | 23.44 |
| Water | 36.04 |
| TOTAL | 100.00 |

| Example 4 (Zinc Stearate/Ammonia Complex) | Parts |
|---|---|
| Dispersion A-3 (Chromogenic Material is Dibutyl N-102) | 4.80 |
| Dispersion B-2 (Acidic Material is Bisphenol A) | 13.44 |
| Dispersion C-1 (Sensitizing Material is DPE) | 13.44 |
| Zinc Stearate/Ammonia Complex at 22% | 10.90 |
| Filler | 3.90 |
| Binder, 10% Solution of Polyvinyl Alcohol in Water | 23.45 |
| Water | 30.07 |
| TOTAL | 100.00 |

The pH of Example 4 was then raised to pH=10.8 with concentrated ammonium hydroxide (27% Ammonia).

See Table 2 for Thermal Image Response and Stability Data.

| Example 5 (Control) | Parts |
|---|---|
| Dispersion A-1 (Chromogenic Material is N-102) | 6.45 |
| Dispersion A-2 (Chromogenic Material is CF-51) | 1.79 |
| Dispersion E (Acidic & Sensitizing Material Codispersion) | 22.77 |
| Zinc Stearate Emulsion at 32.3% solids | 5.18 |
| Methylol Stearamide Emulsion at 23% solids | 8.37 |
| Dispersion D (Filler Material) | 28.02 |
| Binder, 10% Solution of Methyl Cellulose in Water | 2.03 |
| Binder, 10% Solution of Polyvinyl Alcohol in Water | 21.21 |
| Optical Brightener at 22% solids | .34 |
| Water | 3.84 |
| TOTAL | 100.00 |

| Example 6 (Zinc Stearate/Ammonia Complex) | Parts |
|---|---|
| Dispersion A-1 (Chromogenic Material is N-102) | 6.47 |
| Dispersion A-2 (Chromogenic Material is CF-51) | 1.79 |
| Dispersion E (Acidic & Sensitizing Material Codispersion) | 22.85 |
| Zinc Stearate/Ammonia Complex at 22% | 14.25 |
| Methylol Stearamide Emulsion at 23% solids | 8.41 |
| Dispersion D (Filler Material) | 19.26 |
| Binder, 10% Solution of Methyl Cellulose in Water | 2.34 |
| Binder, 10% Solution of Polyvinyl Alcohol in Water | 22.14 |
| Optical Brightener at 22% solids | .36 |
| Water | 2.13 |
| TOTAL | 100.00 |

The pH of Example 6 coating mixture was raised to pH=10.8 with ammonia.

See Table 3 for Thermal Image Response and Stability Data.

| Example 7 (Control Complex) | Parts |
|---|---|
| Dispersion A-1 (Chromogenic Material is N-102) | 4.80 |
| Dispersion B-1 (Acidic Material is AP-5) | 13.44 |
| Dispersion C-1 (Sensitizing Material is DPE) | 13.44 |
| Zinc Stearate/Ammonia Complex at 22% Solids | 12.00 |
| Filler | 3.90 |
| Binder, 10% Solution of Polyvinyl Alcohol in Water | 23.46 |
| Water | 28.96 |
| TOTAL | 100.00 |

| Example 8 (Complex Containing Zinc Oxide) | Parts |
|---|---|
| Dispersion A-1 (Chromogenic Material is N-102) | 4.80 |
| Dispersion B-1 (Acidic Material is AP-5) | 13.44 |
| Dispersion C-1 (Sensitizing Material is DPE) | 13.44 |
| Zinc Stearate/Zinc Oxide/Ammonia Complex at 22% Solids | 12.00 |
| Filler | 3.90 |
| Binder, 10% Solution of Polyvinyl Alcohol in Water | 23.46 |
| Water | 28.96 |
| TOTAL | 100.00 |

The pH of Examples 7 and 8 were raised to 10.8 using conecnetrated ammonium hydroxide (27% ammonia).

See Table 4 for Thermal Image Response and Stability Data.

TABLE 1

| Dynamic Response/MacBeth Intensities | | |
|---|---|---|
| Pulse Width (msec) | Example 1 N-102/AP-5 Control | Example 2 N-102/AP-5/Complex |
| 1.0 | 1.40 | 1.35 |
| 0.9 | 1.39 | 1.35 |

TABLE 1-continued

| | | |
|---|---|---|
| 0.8 | 1.36 | 1.34 |
| 0.7 | 1.30 | 1.33 |
| 0.6 | 1.13 | 1.27 |
| 0.5 | 0.77 | 1.01 |
| 0.4 | 0.40 | 0.59 |
| 0.3 | 0.15 | 0.21 |
| 0.1 | 0.08 | 0.08 |

Macbeth Intensities of Image Remaining after 60° C. Exposure for 24 Hours:

| Pulse Width (msec) | Example 1 | (% Image) Loss | Example 2 | (% Image) Loss |
|---|---|---|---|---|
| 1.0 | 1.36 | (2.9) | 1.35 | (0.0) |
| 0.9 | 1.31 | (5.8) | 1.36 | (+0.7) |
| 0.8 | 1.11 | (18.4) | 1.32 | (1.5) |
| 0.7 | 0.85 | (34.6) | 1.23 | (7.5) |
| 0.6 | 0.48 | (57.5) | 0.95 | (25.2) |
| 0.5 | 0.24 | (68.8) | 0.59 | (41.6) |
| 0.4 | 0.15 | (62.5) | 0.30 | (49.2) |
| 0.3 | 0.12 | (20.0) | 0.17 | (19.0) |
| 0.2 | 0.12 | (—) | 0.15 | (—) |
| 0.1 | 0.12 | (—) | 0.15 | (—) |

TABLE 2

Dynamic Response/MacBeth Intensities

| Pulse Width (msec) | Example 3 Dibutyl N-102 Bisphenol A Control | Example 4 Dibutyl N-102/ Bisphenol A/Complex |
|---|---|---|
| 1.0 | 1.37 | 1.35 |
| 0.9 | 1.36 | 1.34 |
| 0.8 | 1.34 | 1.33 |
| 0.7 | 1.30 | 1.32 |
| 0.6 | 1.21 | 1.27 |
| 0.5 | 0.92 | 1.11 |
| 0.4 | 0.51 | 0.69 |
| 0.3 | 0.17 | 0.25 |
| 0.2 | 0.10 | 0.11 |
| 0.1 | 0.09 | 0.10 |

MacBeth Intensities of Image Remaining after 60° C. Exposure for 24 Hours:

| Pulse Width (msec) | Example 1 | (% Image) Loss | Example 2 | (% Image) Loss |
|---|---|---|---|---|
| 1.0 | 1.29 | (5.8) | — | (—) |
| 0.9 | 1.11 | (18.4) | 1.21 | (9.7) |
| 0.8 | 0.88 | (34.3) | 1.15 | (13.5) |
| 0.7 | 0.58 | (55.4) | 0.80 | (39.4) |
| 0.6 | 0.38 | (68.6) | 0.59 | (53.5) |
| 0.5 | 0.23 | (75.0) | 0.40 | (64.0) |
| 0.4 | 0.16 | (68.6) | 0.25 | (63.8) |
| 0.3 | 0.13 | (23.5) | 0.18 | (28.0) |
| 0.2 | 0.12 | (—) | 0.17 | (—) |
| 0.1 | 0.12 | (—) | 0.16 | (—) |

TABLE 3

Dynamic Response/MacBeth Intensities

| Pulse Width (msec) | Example 5 T-1000 Fax Grade Control | Example 6 T-I000 Fax Grade/Complex |
|---|---|---|
| 1.0 | 1.43 | 1.39 |
| 0.9 | 1.43 | 1.39 |
| 0.8 | 1.42 | 1.36 |
| 0.7 | 1.38 | 1.33 |
| 0.6 | 1.21 | 1.18 |
| 0.5 | 0.92 | 0.92 |
| 0.4 | 0.44 | 0.48 |
| 0.3 | 0.15 | 0.20 |

MacBeth intensities of Image Remaining after 60° C. Exposure for 24 Hours:

| Pulse Width (msec) | Example 1 | (% Image) Loss | Example 2 | (% Image) Loss |
|---|---|---|---|---|
| 1.0 | 1.38 | (3.5) | 1.40 | (+.7) |
| 0.9 | 1.35 | (5.6) | 1.38 | (0.7) |
| 0.8 | 1.29 | (9.2) | 1.33 | (2.2) |
| 0.7 | 1.16 | (15.9) | 1.22 | (8.3) |
| 0.6 | 0.83 | (31.4) | 1.01 | (14.4) |
| 0.5 | 0.55 | (40.2) | 0.67 | (27.2) |
| 0.4 | 0.24 | (45.5) | 0.30 | (37.5) |
| 0.3 | 0.14 | (6.7) | 0.16 | (20.0) |
| 0.2 | 0.13 | (—) | 0.13 | (—) |
| 0.1 | 0.14 | (—) | 0.13 | (—) |

TABLE 4

Dynamic Response/MacBeth Intensities

| Pulse Width (msec) | Example 7 Complex Control | Example 8 (Complex + Zinc Oxide) |
|---|---|---|
| 1.0 | 1.31 | 1.35 |
| 0.9 | 1.30 | 1.35 |
| 0.8 | 1.29 | 1.34 |
| 0.7 | 1.28 | 1.33 |
| 0.6 | 1.22 | 1.27 |
| 0.5 | 1.06 | 1.01 |
| 0.4 | 0.62 | 0.59 |
| 0.3 | 0.23 | 0.21 |
| 0.2 | 0.10 | 0.09 |
| 0.1 | 0.08 | 0.08 |

MacBeth intensities of Image Remaining after 60° C. Exposure for 24 Hours:

| Pulse Width (msec) | Example 7 | (% Image) Loss | Example 8 | (% Image) Loss |
|---|---|---|---|---|
| 1.0 | 1.33 | +1.5 | 1.35 | 0.0 |
| 0.9 | 1.32 | +1.5 | 1.36 | +0.7 |
| 0.8 | 1.29 | 0.0 | 1.32 | 1.5 |
| 0.7 | 1.22 | 4.7 | 1.23 | 7.5 |
| 0.6 | 1.01 | 17.2 | 0.95 | 25.2 |
| 0.5 | 0.69 | 34.9 | 0.59 | 41.6 |
| 0.4 | 0.37 | 40.3 | 0.30 | 49.2 |
| 0.3 | 0.20 | 13.0 | 0.17 | 19.0 |
| 0.2 | 0.17 | — | 0.15 | — |
| 0.1 | 0.17 | — | 0.15 | — |

What is claimed is:

1. A thermally-responsive record material comprising a support having provided thereon in substantially contiguous relationship an electron-donating dye precursor, an acidic developer material, a sensitizer, a zinc stearate and ammonia complex formed by admixture of ammonium hydroxide and zinc stearate wherein the admixture has a pH greater than 10.5.

2. The thermally-responsive record material according to claim 1 wherein the admixture has a pH of at least 10.8.

3. The thermally-responsive record material according to claim 1 wherein the sensitizer is selected from acetoacet-o-toluidine, phenyl-1-hydroxy-2-naphthoate, 1,2-diphenoxyethane, or p-benzylbiphenyl.

4. The thermally-responsive record material according to claim 1 wherein the electron-donating dye precursor is selected from a phthalide, leucauramine, or fluoran.

5. The thermally-responsive record material according to claim 4 wherein the zinc stearate and ammonia complex is a room temperature solid.

6. The thermally-responsive record material according to claim 1 wherein the zinc stearate and ammonia complex includes in addition zinc oxide.

7. The thermally-responsive record material according to claim 6 wherein the acidic developer material is selected from 2,2-bis(4-hydroxyphenyl)-4-methylpentane, 4,4'-isopropylidenediphenol, ethyl-4,4-bis(4-hydroxyphenyl)pentanoate, p-hydroxybenzophenone, or benzyl-p-hydroxybenzoate.

8. A thermally-responsive record material comprising a support having provided thereon in substantially contiguous relationship an admixture of an electron-donating dye precursor, an acidic developer material, a sensitizer, and zinc stearate said mixture having a pH elevated to at least 10.5 by addition of ammonium hydroxide.

9. The thermally-responsive record material according to claim 8 including in addition zinc oxide.

10. The thermally-responsive record material according to claim 8 wherein the pH of the mixture is elevated to at least 10.8.

* * * * *